US007240768B2

(12) United States Patent
Sageman

(10) Patent No.: US 7,240,768 B2
(45) **Date of Patent: *Jul. 10, 2007**

(54) FLAPPER FINGER VALVE

(75) Inventor: Robert J. Sageman, Rochester Hills, MI (US)

(73) Assignee: Barnes Group Inc., Bristol, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/089,867

(22) Filed: Mar. 25, 2005

(65) Prior Publication Data

US 2005/0161282 A1 Jul. 28, 2005

Related U.S. Application Data

(63) Continuation of application No. 10/690,130, filed on Oct. 21, 2003, now Pat. No. 6,899,199.

(60) Provisional application No. 60/420,825, filed on Oct. 24, 2002.

(51) Int. Cl.
*F16K 25/02* (2006.01)
*F16K 15/16* (2006.01)
*F16K 17/00* (2006.01)

(52) U.S. Cl. ..... 181/237; 181/236; 181/254; 251/84; 137/469; 137/505.11; 137/847

(58) Field of Classification Search ..... 181/237, 181/236, 254, 241, 249, 255, 271, 277; 251/84, 251/12; 137/469, 847, 505.11, 476, 477, 137/505, 846; 123/184.53, 184.54, 188.4, 123/188.15, 188.2, 188.5; 60/324
See application file for complete search history.

(56) References Cited

U.S. PATENT DOCUMENTS 1,173,583 A 2/1916 Johnson et al.
1,599,414 A 9/1926 Huff (Continued)

FOREIGN PATENT DOCUMENTS

CA 2097032 5/1993

(Continued)

OTHER PUBLICATIONS

EP 05 01 1547, European Search Report, Barnes Group Inc., Jul. 21, 2005.

(Continued)

*Primary Examiner*—Edgardo San Martin
(74) *Attorney, Agent, or Firm*—Fay Sharpe LLP; Brian E. Turung

(57) ABSTRACT

A flapper finger valve assembly for use in an exhaust system. The flapper finger valve includes a tube having a plurality of orifices therethrough. The flapper finger valve assembly also includes a plurality of flapper finger valves generally having a C-shape wherein the flapper finger valves are arranged on an outside surface of the tube. The flapper finger valves are capable of radial movement with respect to the tube. A plurality of retainers generally having a C-shape are arranged around the flapper finger valve. These retainers will define a maximum radial movement for such flapper finger valves on the tube. The flapper finger valve assembly also includes a fastener which will secure the flapper finger valves between a tube and retainers in the flapper finger valve assembly.

57 Claims, 7 Drawing Sheets

U.S. PATENT DOCUMENTS

| | | | | | |
|---|---|---|---|---|---|
| 1,614,124 | A | | 1/1927 | Hansen | |
| 1,860,163 | A | * | 5/1932 | Wyzenbeek | 137/512.3 |
| 2,933,148 | A | * | 4/1960 | Hendry | 181/246 |
| 3,006,160 | A | | 10/1961 | Heidorn | |
| 3,132,716 | A | * | 5/1964 | Williams | 181/240 |
| 3,779,340 | A | | 12/1973 | Hoffman | |
| 3,783,590 | A | | 1/1974 | Allen | |
| 3,807,444 | A | | 4/1974 | Fortune | |
| 3,882,891 | A | * | 5/1975 | Viles et al. | 137/512.15 |
| 3,894,611 | A | * | 7/1975 | Raudman, Jr. | 181/237 |
| 3,923,122 | A | | 12/1975 | Itria | |
| 4,006,794 | A | * | 2/1977 | Itria | 181/115 |
| 4,042,062 | A | | 8/1977 | Tooley | |
| 4,078,808 | A | | 3/1978 | Hughes, Jr. | |
| 4,079,808 | A | | 3/1978 | Mizuno | |
| 4,179,883 | A | | 12/1979 | Nishiyama | |
| 4,327,817 | A | * | 5/1982 | Scarton et al. | 181/296 |
| 4,346,783 | A | | 8/1982 | Scarton | |
| 4,484,659 | A | | 11/1984 | Buchwalder | |
| 4,522,374 | A | | 6/1985 | Neff | |
| 5,022,833 | A | | 6/1991 | Kandpal | |
| 5,073,146 | A | | 12/1991 | Beck | |
| 5,269,499 | A | | 12/1993 | Schwab | |
| 5,299,961 | A | | 4/1994 | Okamoto | |
| 3,277,830 | A | | 10/1996 | Kalert et al. | |
| 5,614,699 | A | | 3/1997 | Yashiro | |
| 5,934,959 | A | | 8/1999 | Inmann | |
| 5,971,098 | A | | 10/1999 | Suzuki | |
| 6,019,132 | A | | 2/2000 | Knapp | |
| 6,065,564 | A | * | 5/2000 | Uegane | 181/237 |
| 6,079,516 | A | | 6/2000 | Pearson | |
| 6,167,699 | B1 | | 1/2001 | Johnston | |
| 6,173,808 | B1 | | 1/2001 | Maeda | |
| 6,189,650 | B1 | | 2/2001 | Inuzuka | |
| 6,227,814 | B1 | | 5/2001 | Yokomachi et al. | |
| 6,227,825 | B1 | | 5/2001 | Vay | |
| 6,412,514 | B1 | | 7/2002 | Raftis | |
| 6,435,302 | B1 | | 8/2002 | Chen | |
| 6,457,553 | B1 | | 10/2002 | Goplen et al. | |
| 6,622,819 | B2 | | 9/2003 | Reynolds | |
| 6,705,813 | B2 | | 3/2004 | Schwab | |
| 6,752,603 | B2 | | 6/2004 | Murase et al. | |
| 6,899,199 | B2 | * | 5/2005 | Sageman | 181/237 |
| 7,066,296 | B2 | | 6/2006 | Uegane | |
| 2003/0044294 | A1 | | 3/2003 | Shintoku | |
| 2003/0147723 | A1 | | 8/2003 | Schwab | |
| 2004/0065503 | A1 | | 4/2004 | Uegane | |
| 2005/0161282 | A1 | | 7/2005 | Sageman | |

FOREIGN PATENT DOCUMENTS

| | | | | |
|---|---|---|---|---|
| DE | 199 57 711 | A1 | | 4/2001 |
| DE | 19957711 | | | 4/2001 |
| JP | 60162007 | | | 8/1985 |
| JP | 03031509 | A | * | 2/1991 |
| JP | 10-141041 | | | 5/1998 |
| JP | 60-162007 | | | 1/2001 |
| JP | 2001-020718 | | | 1/2001 |
| JP | 2001020718 | A | | 1/2001 |
| JP | 2001-123817 | | | 5/2001 |
| JP | 2002-180815 | | | 6/2002 |
| JP | 2004-124905 | | | 4/2004 |

OTHER PUBLICATIONS

European Seach Report for EP 03 25 6721—Mar. 1, 2004.

* cited by examiner

FLAPPER FINGER VALVE

CROSS-REFERENCE TO RELATED APPLICATIONS

This application is a continuation of application Ser. No. 10/690,130, filed on Oct. 21, 2003 now U.S. Pat. No. 6,899,199, which claims the benefit of Provisional Application Ser. No. 60/420,825, filed Oct. 24, 2002, both of which are hereby incorporated by reference in their entireties.

BACKGROUND OF THE INVENTION

1. Field of the Invention

The invention will broadly relate to exhaust systems and mufflers, and more particularly relate to a flapper finger valve assembly that will be used in an automotive exhaust system to define a flow path for exhaust gasses that are released under high pressure and high flow conditions.

2. Description of Related Art

It is well known in the art to use mufflers on automotive vehicles to silence exhaust noise and to control the back pressure on the power train. Generally, mufflers are stamped from typically known steel, aluminum or the like and will use multiple internal baffles and tubes to silence the exhaust noise from the power train. In prior art mufflers exhaust enters one end of a muffler and is moved through a series of baffles and tubes in the interior of the muffler, to an exhaust tube and then on to a tailpipe. The design of the baffles, the number of baffles, the holes in the baffles, and any piping within the muffler all relate to the pressure and flow conditions through the muffler and exhaust system of the automotive vehicle. The size of the prior art muffler and exhaust systems of automotive vehicles is rather large in order to accomplish the baffling and noise reduction required by the muffler systems. The size of the exhaust systems require a lot of the packaging room available on the undercarriage of the chassis system of the automotive vehicles. The tuning and control of other characteristics of the muffler also can increase the performance and other associated characteristics of the automotive vehicle depending on the design of the baffles and the amount of pressure allowed to be released and at what flow rate the pressure is released through the exhaust system. Therefore, the performance characteristics of the vehicle that are effected by the release of pressure through the exhaust system in many prior art vehicles is fixed once the exhaust system is installed. Hence, the size of the muffler had to be large to correctly tune and dampen noise as required by the exhaust muffler system.

Therefore, there is a need in the art for a low cost exhaust system that reduces the package size of the muffler for the underbody of the chassis. There also is a need for an exhaust system that can be tuned or controlled without changing the size of the muffler and the number of baffles or tubes within the muffler system.

SUMMARY OF THE INVENTION

One object of the present invention is to provide a low cost flapper finger valve assembly which defines a flow path for the exhaust gasses of an exhaust system to be released under high pressure or high flow conditions.

Another object of the present invention is to provide an exhaust system that is capable of a variety of configurations to control and/or fine tune the exhaust system per application requirements of the motor vehicle characteristics.

Still another object of the present invention is to provide an exhaust system that includes a muffler with a smaller package thus reducing the amount of room used on the chassis underbody.

Still another object of the present invention is to provide flapper finger valve assembly that can independently operate or operate within an existing muffler to regulate the flow path for exhaust gasses in an exhaust system of an automotive vehicle.

According to the present invention, the foregoing and other objects and advantages are obtained by a novel design for a flapper finger valve assembly for use in an automotive exhaust system. The flapper finger valve assembly would either be an independent mechanism or integrated into an assembly for a muffler or exhaust system to create and regulate flow through a path for exhaust gasses to be released under high pressure and high flow conditions in the exhaust system. The flapper finger valve assembly includes at least one flapper finger valve connected to an exhaust tube and an exhaust pressure relief valve retainer or backer.

One advantage of the present invention is an improved exhaust or muffler system.

Still another advantage of the present invention is to create an escape path for exhaust gases to be released under high pressure and flow conditions.

Still another advantage of the present invention is the reduction in overall size and packaging requirements for the exhaust system of an automotive vehicle.

Yet another advantage of the present invention is the reduction in weight of the exhaust system for the vehicle.

Still another advantage of the present invention is the tune ability and variability of the exhaust system by changing design requirements of the flapper finger valves.

Other objects, features and advantages of the present invention will become apparent from the subsequent description in the appended claims, taken in conjunction with the accompanying drawings.

Figure 1A:
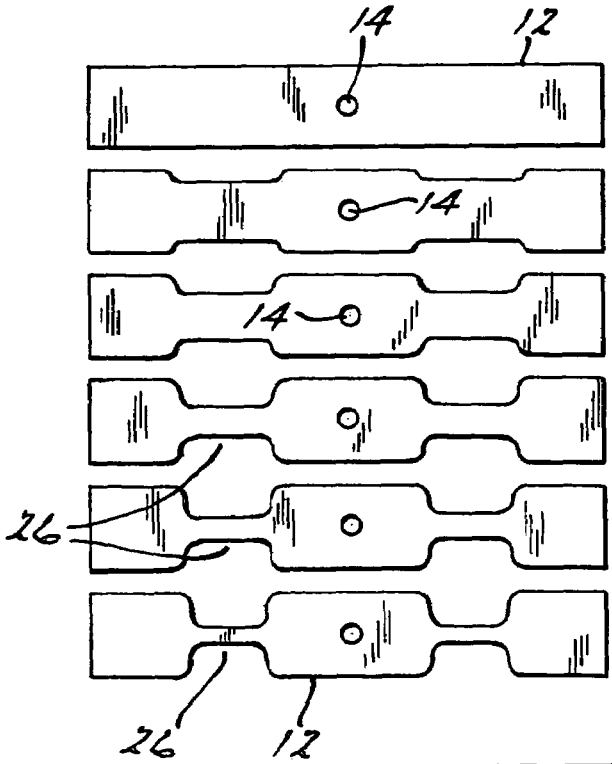
FIGS. 1A–1E show a flapper finger valve assembly according to the present invention.
Figure 1B:
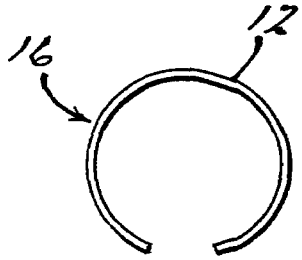
Figure 1C:
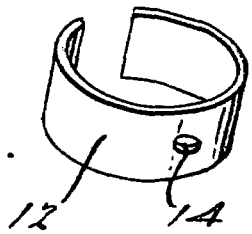
Figure 1D:
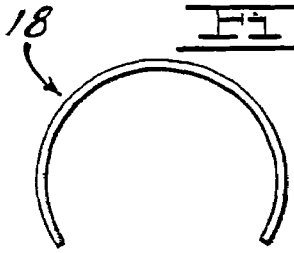
Figure 1E:
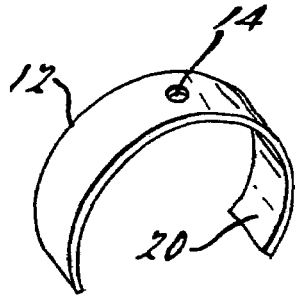

DESCRIPTION OF THE PREFERRED EMBODIMENT(S) AND BEST MODE OF CARRYING OUT THE INVENTION

Referring to the drawings, FIGS. 1 through 14 show the flapper finger valve assembly 10 according to the present invention. The flapper finger valve assembly 10 will be for use on a muffler or exhaust system component 38 and/or as a stand alone unit that will allow for the propagation of the exhaust gasses through a predetermined path for release under high pressure and high flow conditions. The use of the flapper finger valve assembly 10 will allow for a reduction in the packaging size of the muffler 38 thus increasing available space on the undercarriage of the chassis of an automotive vehicle. Furthermore the reduction in size will also reduce the weight and manufacturing costs of the muffler or exhaust system 38. It should further be noted that the flapper finger valve assembly 10 will be available in a variety of configurations and will also allow for a variable control or fine tuning of the exhaust system and power train of the vehicle.

FIG. 1 shows the exhaust pressure flapper finger valve or relief valve 12 according to the present invention. Generally, the flapper finger valve 12 has an overall C-shape. The valve 12 has an orifice 14 through a surface thereof at or near a top point thereof. FIG. 1 shows the valve in a closed position 16 and in an open position 18. It should be noted that generally the flapper finger valve 12 will be made of a steel material that will have a predetermined spring coefficient. It should be noted that any other type of metal, ceramic, plastic, composite or any other type of material may be used for the flapper finger valve 12. As shown in FIG. 1 the flapper finger valve 12 also includes, on both ends thereof, a predetermined bend 20 at a predetermined angle which will be used to cover and seal a predetermined orifice 22 in the exhaust system. The flapper finger valve 12 is designed such that it controls the release of the exhaust pressure and flow of the exhaust in a predetermined manner. The steel will have a predetermined spring coefficient that in one embodiment will be in the closed position in its equilibrium position. Then when a predetermined pressure from the exhaust is placed upon an inner surface of the flapper finger valve 12, the flapper finger valve 12 will be urged in an outer direction thus increasing the size of the C and bending the finger valve 12 outward in a radial direction. The flapper finger valve 12 must have the proper spring characteristics and the ability to open and close at various pressures and within predetermined time constraints. It should further be noted that the profile or predetermined bend 20 in each of the flapper finger valves 12 may vary depending on the relief orifices 22 in the exhaust tube 24. It should further be noted that the finger valve has a predetermined thickness which will also affect the characteristics of the exhaust system. The thickness of the material will be matched to the pressure and noise reduction requirements of the exhaust system. The thicker the material the more pressure and the greater flow needed to open the valve 12. Therefore, the thinner the material the quicker the valve 12 will open, thus releasing exhaust pressure through the muffler system. It should be noted that the flapper finger valve 12 can be placed on the outer circumference of an exhaust tube 24 or on an inner circumference of an exhaust tube 24 depending on the design requirements and flow direction needed for the exhaust. Furthermore, a bridge 26, as shown in FIG. 1, will reduce the width of the flapper finger valve 12 at predetermined positions based on the pressure and flow requirements needed along with the response time in the exhaust system. Therefore, all of the variables discussed above can be changed on the flapper finger valve 12 to fine tune and/or configure the exhaust system to predetermined specifications.

Figure 2A:
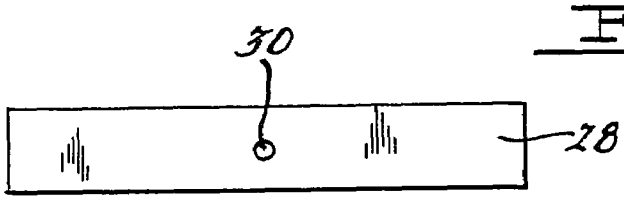
FIGS. 2A–2C show a flapper finger valve assembly according to the present invention.
Figure 2B:
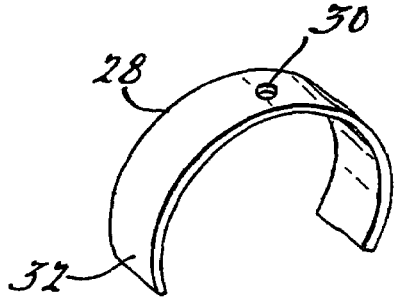
Figure 2C:
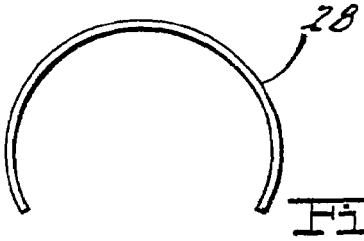
Figure 3A:
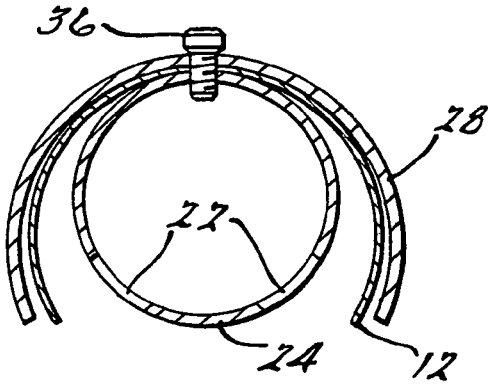
FIGS. 3A–3H show an exhaust pressure relief valve backer according to the present invention.
Figure 3B:
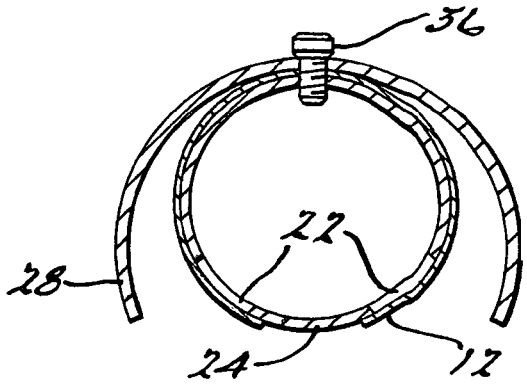
Figure 3C:
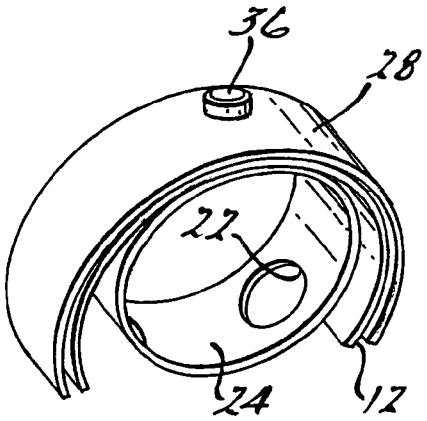
Figure 3D:
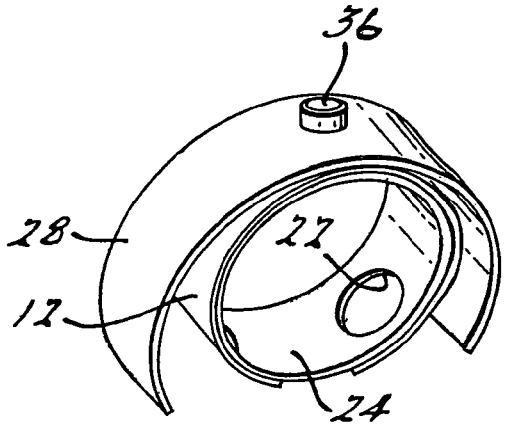
Figure 3E:
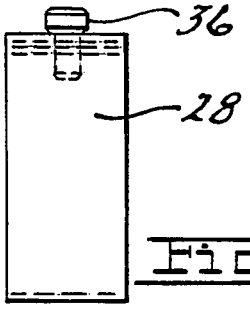
Figure 3H:
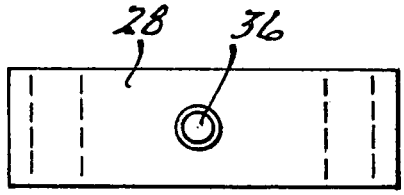
Figure 3F:
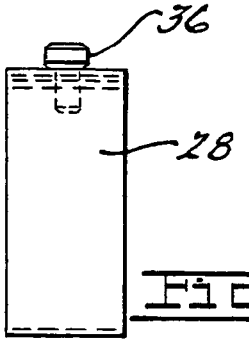
Figure 3G:
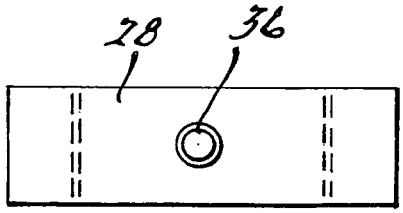
Figure 4A:
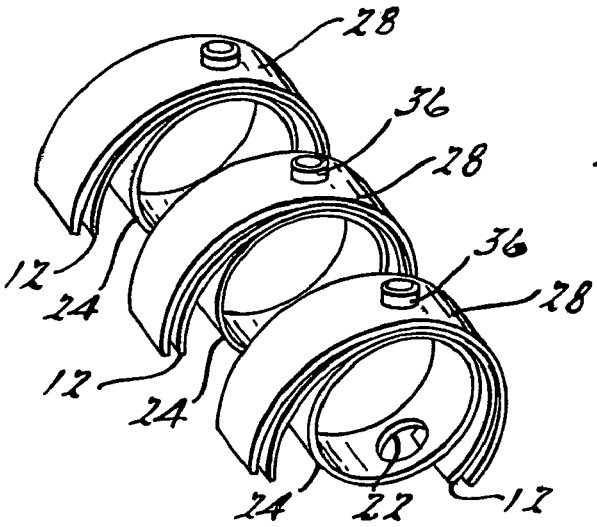
FIGS. 4A–4D show an exhaust pressure relief valve assembly in its open and closed positions.
Figure 4B:
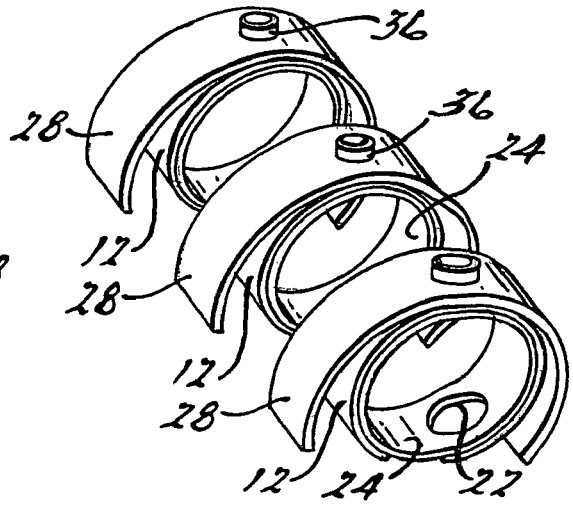
Figure 4C:
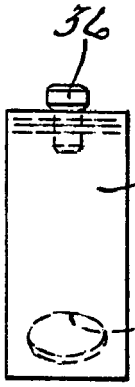
Figure 4D:
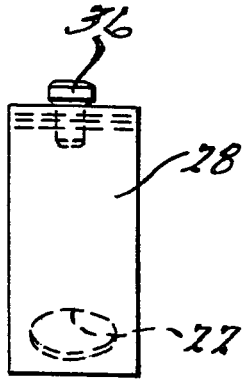

FIG. 2 shows the exhaust pressure relief valve backer or retainer 28 for use in the present invention. The retainer 28 generally has a rectangular shape if viewed flat. However, in its operational mode the retainer 28 generally has a C-shape. The retainer 28 will control the maximum amount of radial travel for the flapper finger valve 12. Therefore, the effective radius of the retainer 28 is a predetermined length that will allow the flapper finger valve 12 to open to a predetermined position or close to a predetermined position depending on the operating requirements of the exhaust system. It should be noted that in one embodiment the retainer 28 is made of a steel material but that it should be noted that any other metal material, plastic, ceramic, composite or any other known material capable of withstanding the pressure and heat of an automotive exhaust system may be used. The exhaust pressure relief valve backer 28 also includes an orifice 30 at a top portion through a surface thereof. This orifice 30 will mate and align with the orifice 14 located on the flapper finger valve 12 and will allow for connection of the retainer 28 and flapper finger valve 12 to an exhaust tube 24. In one embodiment the retainer 28 will be placed and arranged such that an outer surface of the flapper finger valve 12 engages with an inner surface of the retainer 28. The retainer 28 has a fixed radius and does not have the spring coefficient shown in the flapper finger valve 12 and therefore is designed to set an upper limit on the amount of radial movement for the flapper finger valve 12. The exhaust pressure relief valve backer 28 also may include a predetermined bend 32 on both ends thereof. This bend will match with any bend found in the flapper finger valve 12.

Figure 5A:
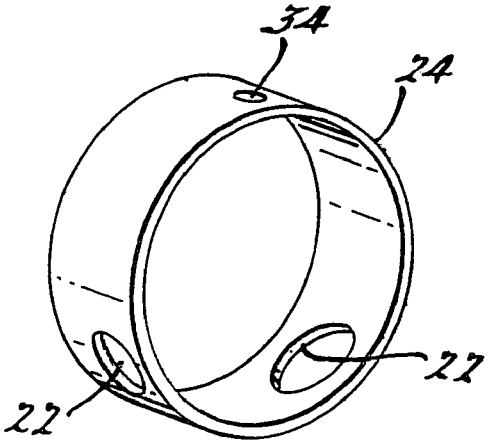
FIGS. 5A–5B show an exhaust pressure relief valve assembly in a series configuration.
Figure 5B:
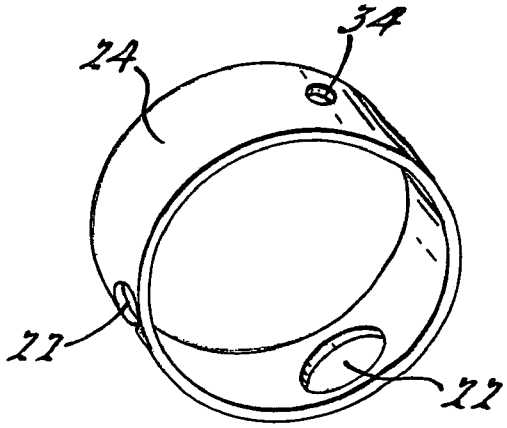
Figure 6A:
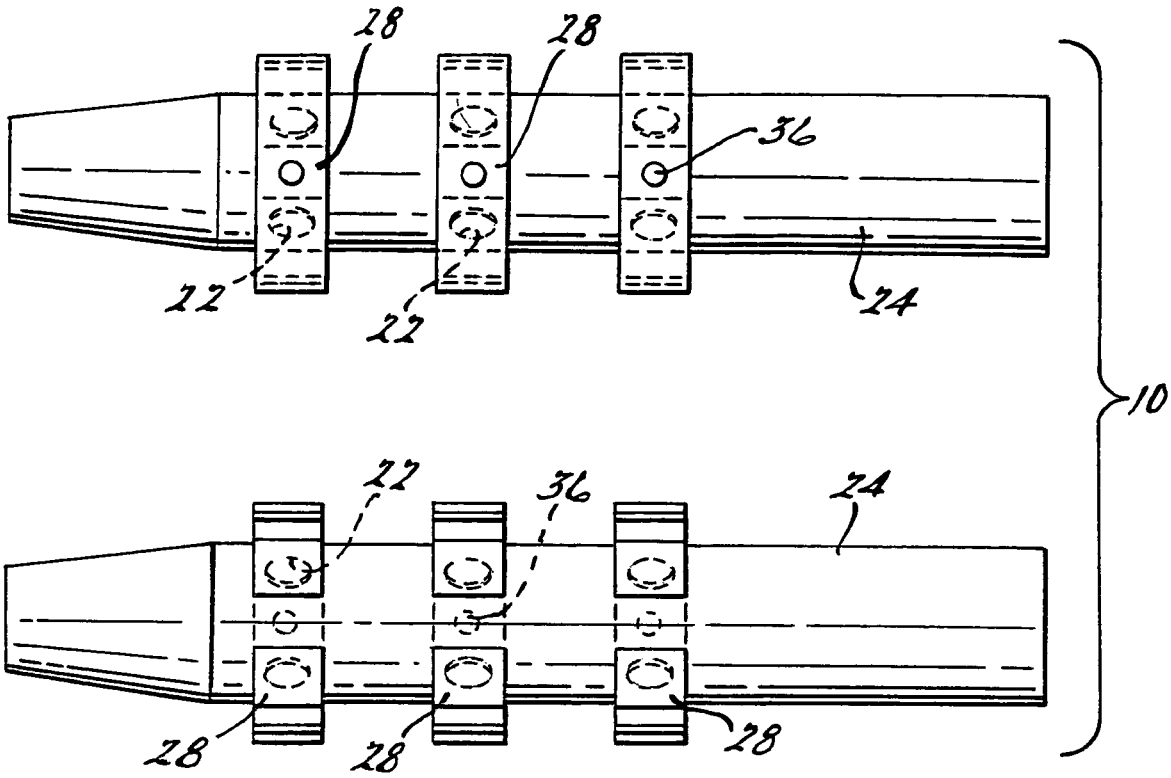
FIGS. 6A–6C show an exhaust pressure tube according to the present invention.
Figure 6B:
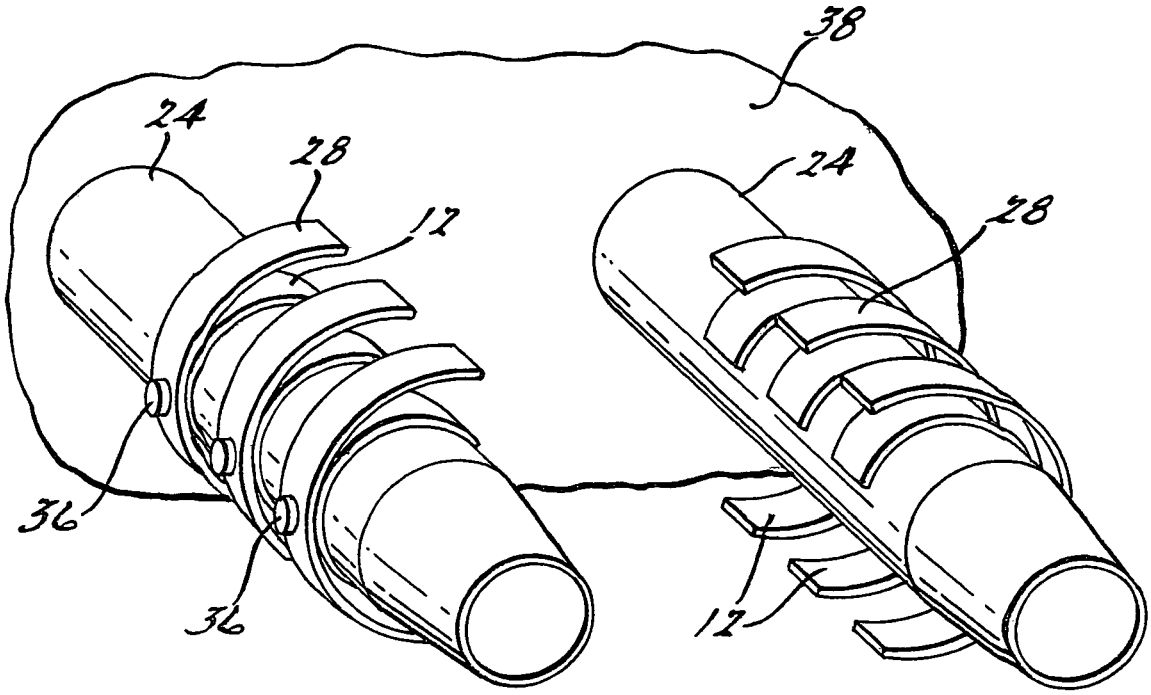
Figure 6C:
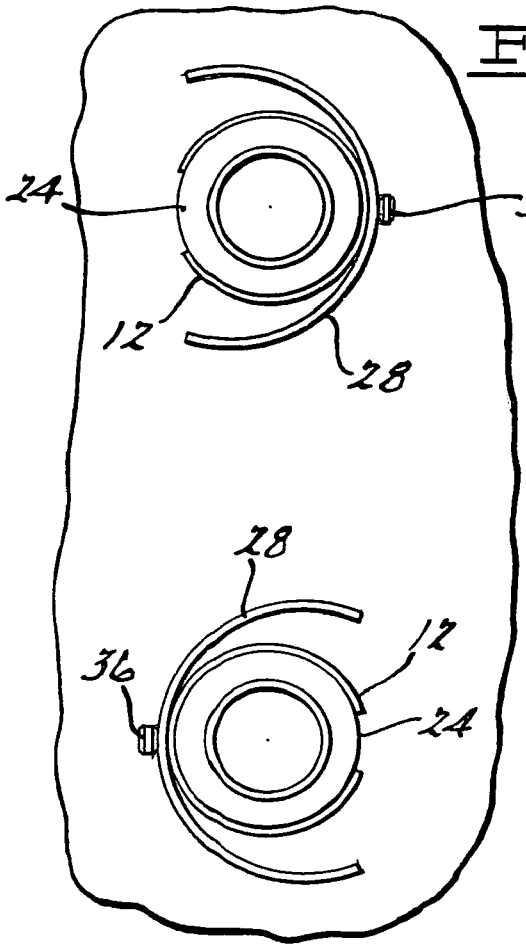
Figure 9:
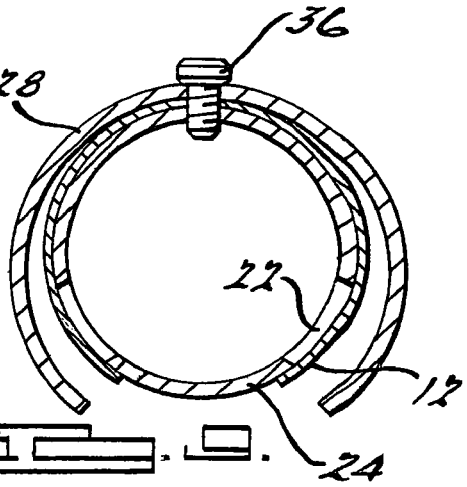
FIG. 9 shows an end view of an exhaust tube with a flapper valve in a closed position.
Figure 10:
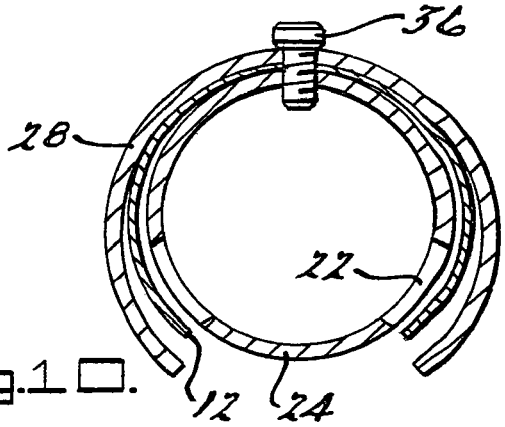
FIG. 10 shows an end view of a flapper valve assembly with the flapper valve in its open position.
Figure 7:
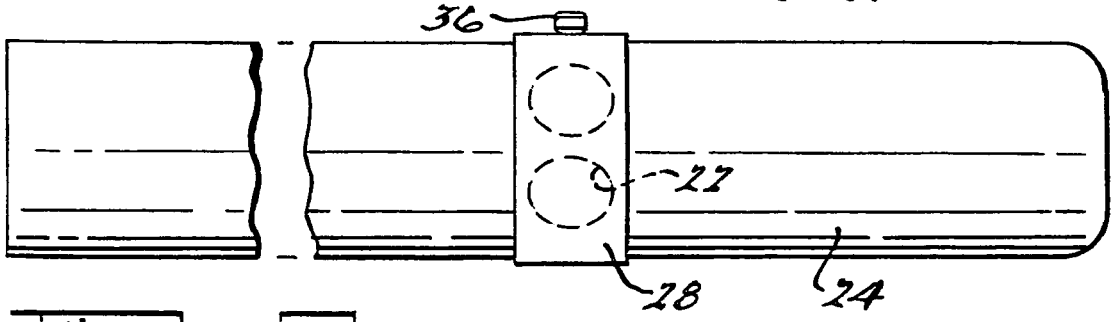
FIG. 7 shows a side view of an exhaust pressure tube according to the present invention.
Figure 8:
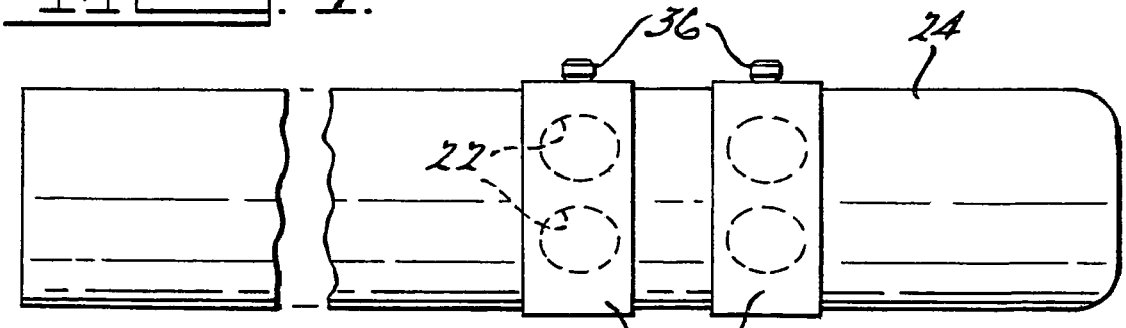
FIG. 8 shows a side view of an alternate embodiment of an exhaust pressure tube according to the present invention.
Figure 11:
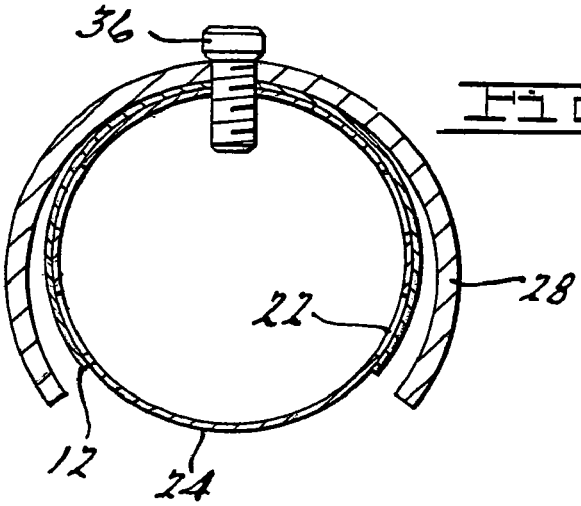
FIG. 11 shows a side view of a flapper valve according to the present invention.
Figure 12:
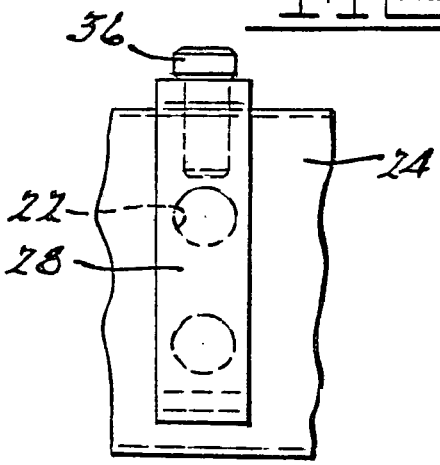
FIG. 12 shows a side view of the flapper valve according to the present invention.
Figure 13:
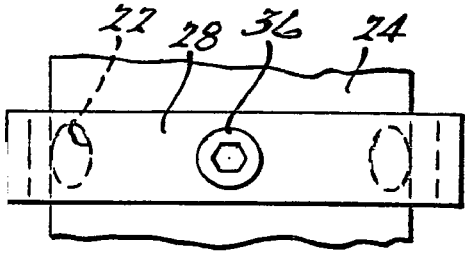
FIG. 13 shows a top view of the flapper valve according to the present invention.
Figure 14:
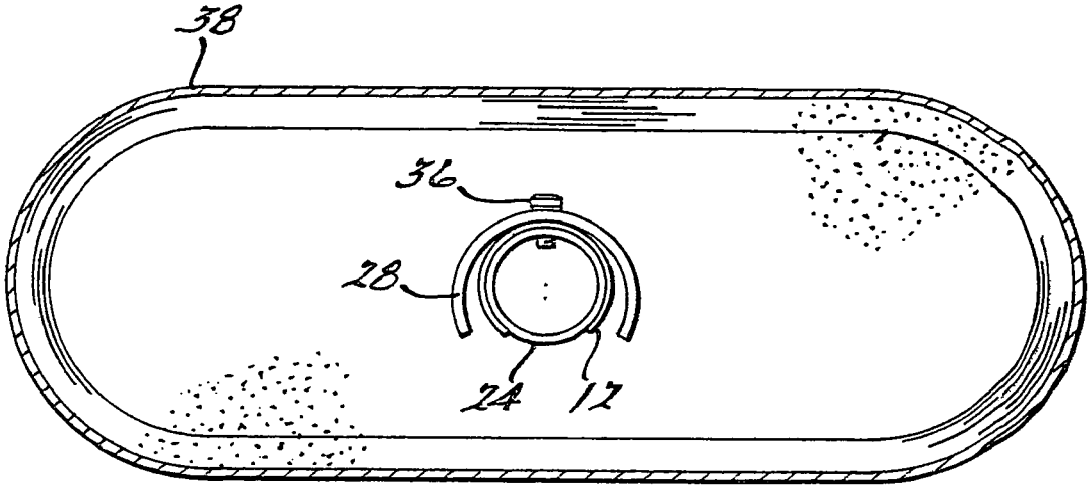
FIG. 14 shows a cross section of a muffler or exhaust system having a flapper finger valve assembly according to the present invention.

FIGS. 5 and 6 show an exhaust pressure tube 24 for use with the flapper finger valve 12 and retainer 28 as discussed above. The exhaust pressure tube 24 will restrict the exhaust flow volume to a predetermined amount to produce the control and fine tuning of the exhaust system for the application required. It should be noted that the exhaust tube 24 generally has a tubular cross section and includes a plurality of orifices. A mounting orifice 34 through one surface thereof will mate with the orifices 14, 30 on the flapper finger valve 12 and retainer 28 to allow for connection of the flapper finger valve 12 and retainer 28 to the exhaust tube 24. A first and second relief orifice 22 are located equal distance from each other through the surface of the exhaust tube 24 opposite from the mounting orifice 34. The size of the relief orifices 22 will determine the amount of flow through the exhaust pressure tube 24 and flapper finger valve 12. It should be noted that in one embodiment the exhaust pressure tube 24 is made of a steel material but that any other known metal, plastic, ceramic, composite or other material capable of withstanding the pressure and heat may also be used for the exhaust pressure tube 24. The exhaust pressure tube 24 will be designed to mate with and align with any known tube within an exhaust system/muffler 38. The relief orifices 22 generally are circular but any other shape may be used depending on the requirements and noise reduction capabilities of any other design. The size of the relief orifices 22 also will be tuned to the specific pressure requirements and flow variations of the flapper finger valve assembly 10. This will allow for multiple pressure and flow control variables depending on the size and/or shape of the flow relief orifices 22.

FIGS. 3, 4 and 6 show the flapper finger valve assembly 10 completely assembled. As shown the exhaust tube 24 is placed within a muffler system 38 or in an tube within an exhaust system at predetermined intervals or at predetermined areas therein. A flapper finger valve 12 is placed directly in contact with the exhaust tube 24 on an outside surface of the exhaust tube 24 and then an inside surface of the retainer 28 is placed in direct contact with an outer surface of the flapper finger valve 12. The orifices 14, 30 on the flapper finger valve 12 and retainer 28 are aligned with the mounting orifice 34 on the exhaust tube 24 and any known fastener or connection method 36 is used to connect the three components to one another, such as but not limited to screws, rivets, inserts, welding or any other mechanical or chemical bonding means. At an equilibrium position the flapper finger valve 12 will engage the entire outer circumference of the exhaust tube 24 and cover the relief orifices 22. During operation once the exhaust pressure increases and the flow increases the valve 12 will open in a radial direction, away from the outer surface of the exhaust tube 24 and allow for flow of the exhaust through the relief orifices 22 and on through the muffler or the exhaust system 38. It should be noted that the flapper finger valve assembly 10 can be placed in parallel or series as shown in FIGS. 4 and 6 or placed anywhere within the exhaust system to achieve the desired tuning and control characteristics of the exhaust system. Therefore, it can be placed in a tube at the beginning of the muffler 38, at the end of the muffler 38 or in a separate independent unit separate from the muffler. The amount of noise reduction and tuning characteristics will depend on the design requirements of the vehicle.

It should further be noted that it is contemplated to have a flapper finger valve assembly 10 that is electronically controlled that will allow the user of the motor vehicle to dial in a specific tuning for the exhaust system. This assembly could use electric solenoids or the like to control how far the finger valves 12 open and which finger valves 12 will even be capable of opening. Furthermore, a plurality of different size and tuned valves 12 may be placed in the same muffler with only specific valves 12 becoming operational at predetermined times depending on the characteristics selected by the motor vehicle operator. It should also be noted that pneumatic, electromechanical, hydraulic or pure mechanical systems are contemplated to control the flapper finger valve assembly 10 in any known contemplated exhaust systems for a vehicle.

Figure 15:
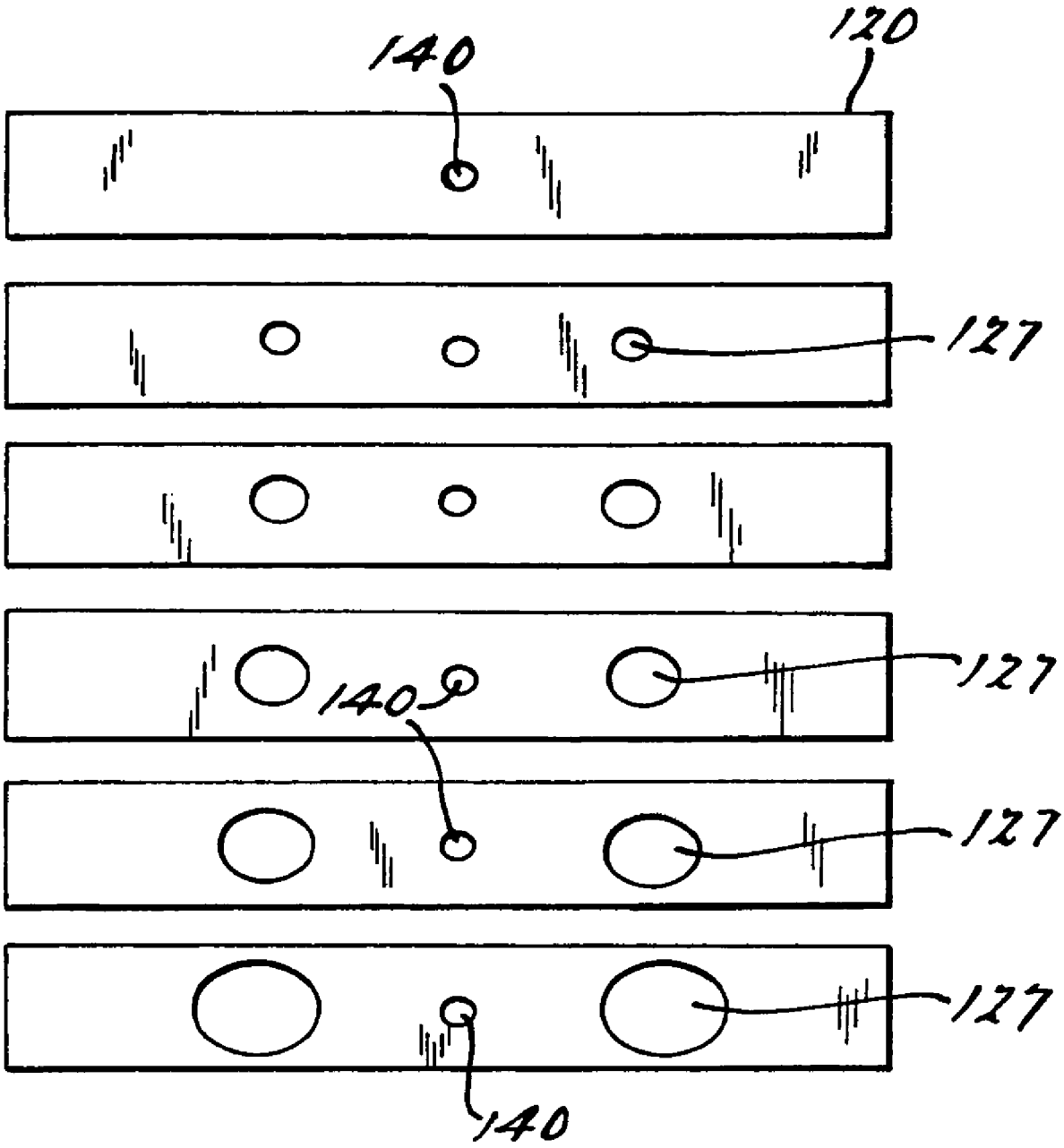
FIG. 15 shows an alternate embodiment of a flapper finger valve assembly according to the present invention.

FIG. 15 shows an alternate embodiment for an exhaust pressure flapper finger valve or relief valve 120 according to the present invention. Generally, the flapper finger valve 120 has an overall C-shape. The valve 120 has a connecting orifice 140 through a surface thereof at or near a top thereof. It should be noted that generally the flapper finger valve 120 will be made of a steel material that will have a predetermined spring coefficient. It should be noted that any other type of metal, ceramic, plastic, composite, fabric, or any other type of material may be used for the flapper finger valve 120. As shown in FIG. 15, the flapper finger valve 120 also includes a plurality of predefined orifices 127 arranged around the connecting orifice 140. The orifices 127 may either be a circular orifice or any other shaped orifice depending on the environment and design requirements of the flapper finger valve 120. The diameter of the orifices 127 are arranged and placed at predetermined positions based on the pressure and flow requirements needed along with the response time in the exhaust system. The large diameter orifices 127 will require less pressure from the exhaust system to open the flapper valve 120 to its open position while smaller diameter orifices 127 will require greater pressure to open the flapper valve 120, thus allowing for release of the exhaust pressure through the muffler system. Therefore, the orifices 127 work in the same manner as the bridges as shown in FIG. 1. Therefore, all of the variables discussed including the shape, size and location of the orifices 127 can be changed on the flapper finger valve 120 to fine tune and/or configure the exhaust system to predetermined specifications.

While it may be apparent that the preferred embodiments of the invention disclosed are well calculated to fill benefits, objects or advantages of the invention, it will be appreciated that the invention is susceptible to modifications, variations and change within departing from the proper scope of the invention as shown. Therefore, within the scope of the appended claims, the present invention may be practiced otherwise than is specifically described.

What is claimed is:

1. A flapper valve designed to be mounted on an outer surface of an exhaust system tube so as to at least partially control axial leakage through openings in the exhaust system tube, said flapper valve comprising a generally flat strip of spring material having first and second ends and an orifice, said first portion including said first end, and said second portion including said second end and extending in a first direction from said first end, said second portion being cantilevered with respect to said first portion with first and second portions at least partially forming an arcuate structure having an arc of at least about 90 degrees, said orifice designed to facilitate in connecting said flapper valve to an exhaust tube.

2. The flapper valve of claim 1, wherein said first portion and said second portions forming an arcuate structure having an arc of at least about 180 degrees.

3. The flapper valve of claim 2, including an orifice through a surface thereof for connection of said flapper valve to an exhaust tube.

4. The flapper valve of claim 1, wherein said flapper valve has a generally C-shape.

5. The flapper valve of claim 2, wherein said flapper valve has a generally C-shape.

6. The flapper valve of claim 3, wherein said flapper valve has a generally C-shape.

7. The flapper valve of claim 2, said first portion and second portions forming a continuous C-shaped structure.

8. The flapper valve of claim 1, wherein said wherein said first and second portions forming a continuous arcuate structure that is greater than about 90 degrees.

9. The flapper valve of claim 8, wherein said wherein said first and second portions forming a continuous arcuate structure that is greater than about 180 degrees.

10. The flapper valve of claim 1, including a limiter designed to limit movement of first portion, said second portion, or combinations thereof.

11. The flapper valve of claim 2, including a limiter designed to limit movement of first portion, said second portion, or combinations thereof.

12. The flapper valve of claim 9, including a limiter designed to limit movement of first portion, said second portion, or combinations thereof.

13. The flapper valve of claim 6, including a limiter designed to limit movement of first portion, said second portion, or combinations thereof.

14. A flapper finger valve assembly adapted to be uses in an exhaust system, said assembly including a tube having a plurality of orifices therethrough and a plurality of flapper finger valves, at least one of said flapper finger valves including a C-shape portion, a plurality of retainers, and at least one fastener to at least partially secure said flapper finger valves and said retainers to said tube; said flapper finger valves arranged on an outside surface of said tube, said flapper finger valves at least partially align with said orifices in said tube such that said orifices are substantially covered by said flapper finger valves when the assembly is in a closed or equilibrium position, at least one of said retainers including a C-shape portion, said retainers arranged at least partially around said flapper finger valves, said retainers having a fixed radius and defining a maximum limit of radial movement for said flapper finger valves when said flapper finger valves are in an open position.

15. An exhaust system comprising a muffler and a flapper finger valve assembly at least partially arranged within said muffler, said flapper finger valve assembly having at least one flapper finger valve having a generally C-shape, said flapper finger valve assembly including a tube with at least one orifice therethrough, said flapper finger valve at least partially covering said orifice in said tube when said flapper finger valve is in a closed position, said flapper finger valve assembly including at least one relief backer arranged at least partially around said flapper finger valve, said relief backer designed to at least partially control a maximum distance of radial movement in an outward direction for said flapper finger valve.

16. The exhaust system as defined in claim 15, wherein said relief backer including a C-shape portion.

17. The exhaust system as defined in claim 15, wherein said flapper finger valve has a predetermined spring coefficient.

18. The exhaust system as defined in claim 16, wherein said flapper finger valve has a predetermined spring coefficient.

19. The exhaust system as defined in claim 15, wherein said flapper finger valve moves in a radially outward direction when exposed to a predetermined pressure.

20. The exhaust system as defined in claim 18, wherein said flapper finger valve moves in a radially outward direction when exposed to a predetermined pressure.

21. The exhaust system as defined in claim 15, wherein said flapper finger valve is capable of being tuned to specific exhaust system characteristics.

22. The exhaust system as defined in claim 20, wherein said flapper finger valve is capable of being tuned to specific exhaust system characteristics.

23. The exhaust system as defined in claim 15, wherein said flapper finger valve has a predetermined bend angle, predetermined thickness, predetermined width, or combinations thereof.

24. The exhaust system as defined in claim 22, wherein said flapper finger valve has a predetermined bend angle, predetermined thickness, predetermined width, or combinations thereof.

25. The exhaust system as defined in claim 15, wherein said flapper finger valve assembly is controllable, tunable, or combinations thereof.

26. The exhaust system as defined in claim 24, wherein said flapper finger valve assembly is controllable, tunable, or combinations thereof.

27. The exhaust system as defined in claim 15, wherein said flapper finger valve and said relief backer are at least partially secured to an outer surface of said tube.

28. The exhaust system as defined in claim 26, wherein said flapper finger valve and said relief backer are at least partially secured to an outer surface of said tube.

29. The exhaust system as defined in claim 15, wherein said flapper finger valve has a predetermined thickness, a predetermined spring coefficient, or combinations thereof, said flapper finger valve designed to open or move radially away from said tube at predetermined exhaust pressures.

30. The exhaust system as defined in claim 28, wherein said flapper finger valve has a predetermined thickness, a predetermined spring coefficient, or combinations thereof, said flapper finger valve designed to open or move radially away from said tube at predetermined exhaust pressures.

31. The exhaust system as defined in claim 15, including a plurality of said flapper finger valve assemblies, said plurality of said flapper finger valve assemblies arranged within a reduced size muffler in parallel or series.

32. The exhaust system as defined in claim 30, including a plurality of said flapper finger valve assemblies, said plurality of said flapper finger valve assemblies arranged within a reduced size muffler in parallel or series.

33. An exhaust system comprising a muffler and a flapper finger valve assembly at least partially arranged within said muffler, said flapper finger valve assembly having at least one flapper finger valve, said flapper finger valve assembly including a tube with at least one orifice, said flapper finger valve at least partially covering said orifice in said tube when said flapper finger valve is in a closed position, said flapper finger valve assembly including at least one relief backer arranged at least partially about said flapper finger valve, said relief backer design to at least partially control a maximum distance of movement in an outward direction from said tube for said flapper finger valve.

34. The exhaust system as defined in claim 33, wherein said flapper finger valve including a C-shaped portion, said relief backer including a C-shape portion.

35. The exhaust system as defined in claim 33, wherein said flapper finger valve and said relief backer are at least partially secured to an outer surface of said tube.

36. The exhaust system as defined in claim 34, wherein said flapper finger valve and said relief backer are at least partially secured to an outer surface of said tube.

37. The exhaust system as defined in claim 33, wherein said at least one orifice in said tube positioned on a side of said tube, said orifice forming an opening into an interior passageway of said tube.

38. The exhaust system as defined in claim 36, wherein said at least one orifice in said tube positioned on a side of said tube, said orifice forming an opening into an interior passageway of said tube.

39. The exhaust system as defined in claim 33, wherein said flapper finger valve has a predetermined spring coefficient, a predetermined bend angle, a predetermined thickness, a predetermined width, or combinations thereof, said flapper finger valve designed to move in an outward direction from said tube when exposed to a predetermined pressure.

40. The exhaust system as defined in claim 38, wherein said flapper finger valve has a predetermined spring coefficient, a predetermined bend angle, a predetermined thickness, a predetermined width, or combinations thereof, said flapper finger valve designed to move in an outward direction from said tube when exposed to a predetermined pressure.

41. The exhaust system as defined in claim 33, wherein said flapper finger valve assembly is controllable, tunable, or combinations thereof.

42. The exhaust system as defined in claim 33, including a plurality of said flapper finger valve assemblies, said plurality of said flapper finger valve assemblies arranged in parallel or series to on another.

43. The exhaust system as defined in claim 40, including a plurality of said flapper finger valve assemblies, said plurality of said flapper finger valve assemblies arranged in parallel or series to one another.

44. The exhaust system as defined in claim 35, wherein said flapper finger valve has a predetermined spring coefficient, a predetermined bend angle, a predetermined thickness, a predetermined width, or combinations thereof, said flapper finger valve designed to move in an outward direction from said tube when exposed to a predetermined pressure.

45. The exhaust system as defined in claim 33, wherein an end portion of said flapper finger valve is spaced from said relief backer when said flapper finger valve is in a closed position and at least a portion of said end portion of said flapper finger valve engages said relief backer when said flapper finger valve is in a fully open position.

46. The exhaust system as defined in claim 33, wherein an end portion of said flapper finger valve spaced from said relief backer when said flapper finger valve is in a closed position and at least a portion of said end portion of said flapper finger valve engages said relief backer when said flapper finger valve is in a fully open position.

47. The exhaust system as defined in claim 33, wherein an end portion of said flapper finger valve is spaced from said relief backer when said flapper finger valve is in a closed position and at least a portion of said end portion of said flapper finger valve engages said relief backer when said flapper finger valve is in a fully open position.

48. A flapper finger valve designed to be mounted on an outer surface of an exhaust system tube so as to at least partially control axial leakage through openings in the exhaust system tube, said flapper finger valve comprising a strip of spring material and at least one relief backer, said strip of spring material having first and second end portions and a bottom and upper surface, said strip of spring material designed to enable said bottom surface to recede from the outer surface of the exhaust system tube, said at least one relief backer arranged at least partially about said upper surface of said strip of spring material, said relief backer design to at least partially control a maximum distance of movement said strip of spring material can recede from the exhaust system tube.

49. The flapper finger valve as defined in claim 48, wherein said strip of spring material includes a C-shaped portion, and said relief backer includes a C-shape portion.

50. The flapper finger valve as defined in claim 48, wherein at least a portion of said relief backer is in constant contact with at least a portion of said strip of spring material.

51. The flapper finger valve as defined in claim 49, wherein at least a portion of said relief backer is in constant contact with at least a portion of said strip of spring material.

52. The flapper finger valve as defined in claim 48, wherein said strip of spring material has a predetermined spring coefficient, a predetermined bend angle, a predetermined thickness, a predetermined width, or combinations thereof, said strip of spring material designed to move in an outward direction from the exhaust system tube when exposed to a predetermined pressure.

53. The flapper finger valve as defined in claim 51, wherein said strip of spring material has a predetermined spring coefficient, a predetermined bend angle, a predetermined thickness, a predetermined width, or combinations thereof, said strip of spring material designed to move in an outward direction from the exhaust system tube when exposed to a predetermined pressure.

54. The flapper finger valve as defined in claim 48, wherein said strip of spring material has a predetermined spring coefficient, a predetermined bend angle, a predetermined thickness, a predetermined width, or combinations thereof, said strip of spring material designed to move in an outward direction from the exhaust system tube when exposed to a predetermined pressure.

55. The flapper finger valve as defined in claim 53, wherein said strip of spring material has a predetermined spring coefficient, a predetermined bend angle, a predetermined thickness, a predetermined width, or combinations thereof, said strip of spring material designed to move in an outward direction from the exhaust system tube when exposed to a predetermined pressure.

56. The flapper finger valve as defined in claim 48, wherein a first end portion of said strip of spring material is spaced from said at least one relief backer when said strip of spring material flapper finger is in a closed position and at least a portion of said first end portion of said strip of spring material engages said at least one relief backer when said strip of spring material is in a fully open position.

57. The flapper finger valve as defined in claim 55, wherein a first end portion of said strip of spring material is spaced from said at least one relief backer when said strip of spring material flapper finger is in a closed position and at least a portion of said first end portion of said strip of spring material engages said at least one relief backer when said strip of spring material is in a fully open position.

* * * * *